US010071875B2

(12) United States Patent
Taki

(10) Patent No.: US 10,071,875 B2
(45) Date of Patent: Sep. 11, 2018

(54) PADDLE ARRANGEMENT FOR SHEET PROCESSING DEVICE WITH STANDBY SECTION

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Hiroyuki Taki, Mishima Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 109 days.

(21) Appl. No.: 15/218,700

(22) Filed: Jul. 25, 2016

(65) Prior Publication Data

US 2017/0166413 A1 Jun. 15, 2017

(30) Foreign Application Priority Data

Dec. 10, 2015 (JP) ..... 2015-240831

(51) Int. Cl.

| | |
|---|---|
| ***B65H 37/04*** | (2006.01) |
| ***B65H 31/34*** | (2006.01) |
| ***B65H 39/10*** | (2006.01) |
| ***B65H 29/34*** | (2006.01) |
| ***B65H 31/02*** | (2006.01) |
| ***B65H 31/30*** | (2006.01) |

(52) U.S. Cl.

CPC ..... *B65H 37/04* (2013.01); *B65H 29/34* (2013.01); *B65H 31/02* (2013.01); *B65H 31/3018* (2013.01); *B65H 31/34* (2013.01); *B65H 39/10* (2013.01); *B65H 2301/4212* (2013.01); *B65H 2301/4213* (2013.01); *B65H 2404/1114* (2013.01); *B65H 2404/63* (2013.01); *B65H 2801/24* (2013.01); *B65H 2801/27* (2013.01)

(58) Field of Classification Search

CPC .... B65H 37/04; B65H 31/02; B65H 31/3018; B65H 31/3027; B65H 31/34; B65H 31/36; B65H 2301/4211; B65H 2301/4212; B65H 2404/1114; B65H 2511/10; B65H 2513/11; B65H 2515/112; B65H 2801/27

See application file for complete search history.

(56) References Cited

U.S. PATENT DOCUMENTS 4,473,425 A * 9/1984 Baughman ..... B42C 1/12 156/356
4,589,654 A * 5/1986 Kanoto ..... B65H 31/34 271/184

(Continued)

*Primary Examiner* — Patrick Hewey Mackey
(74) *Attorney, Agent, or Firm* — Amin, Turocy & Watson LLP

(57) ABSTRACT

In accordance with an embodiment, a sheet processing apparatus comprises an axis of rotation; a standby section configured to buffer a sheet; a processing section configured to execute a post processing on sheets moved from the standby section; a first paddle configured to be mounted in the axis of rotation and be rotated around the axis of rotation to contact with the sheet supplied from the standby section to draw the sheet into a stopper; and a second paddle configured to be mounted in the axis of rotation at a predetermined angle with respect to the first paddle and draw the sheet into the stopper after the first paddle is separated from the sheet after a drawing-in operation of the sheet by the first paddle.

12 Claims, 12 Drawing Sheets

(56) References Cited

U.S. PATENT DOCUMENTS

| | | | | |
|---|---|---|---|---|
| 5,285,249 | A * | 2/1994 | Mahoney | B42B 4/00 270/58.07 |
| 5,338,022 | A * | 8/1994 | Funk | B65H 31/34 271/184 |
| 6,220,592 | B1 | 4/2001 | Watanabe et al. | |
| 6,330,999 | B2 * | 12/2001 | Coombs | B42C 1/12 270/58.08 |
| 6,450,934 | B1 * | 9/2002 | Coombs | B42C 1/12 270/58.12 |
| 6,676,124 | B1 * | 1/2004 | Wirtz | B65H 31/34 271/234 |
| 7,043,192 | B2 | 5/2006 | Terao et al. | |
| 7,215,922 | B2 | 5/2007 | Terao et al. | |
| 7,286,792 | B2 | 10/2007 | Terao et al. | |
| 7,530,565 | B2 * | 5/2009 | Terao | B42C 1/12 271/207 |
| 7,591,468 | B2 * | 9/2009 | Ryan | B65H 31/34 271/187 |
| 7,997,577 | B2 | 8/2011 | Oshiro et al. | |
| 2011/0115152 | A1 | 5/2011 | Suguzaki | |

* cited by examiner

PADDLE ARRANGEMENT FOR SHEET PROCESSING DEVICE WITH STANDBY SECTION

CROSS-REFERENCE TO RELATED APPLICATION

This application is based upon and claims the benefit of priority from Japanese Patent Application No. 2015-240831, filed Dec. 10, 2015, the entire contents of which are incorporated herein by reference.

FIELD

Embodiments described herein relate generally to a sheet processing apparatus for carrying out a post processing on a sheet on which an image is formed.

BACKGROUND

Conventionally, a sheet processing apparatus is known which executes a post processing such as a stapling processing on sheets loaded on a processing tray. In order to adjust deviation between the sheets loaded on the processing tray which are subjected to the post processing, the sheet processing apparatus includes a member for adjusting (horizontally aligning) the deviation in the width direction of the sheet and a member for adjusting (vertically aligning) the deviation in a direction orthogonal to the width direction of the sheet. Particularly, with respect to the deviation in the direction orthogonal to the width direction of the sheet, the deviation of the sheets loaded on the processing tray is aligned by using a vertical alignment member that rotates around an axis of rotation extending in the width direction of the sheet.

DETAILED DESCRIPTION

In accordance with an embodiment, a sheet processing apparatus comprises a standby section configured to buffer a sheet; a processing section configured to receive sheets supplied from the standby section and execute a post processing on the sheets; a rotational shaft configured to rotate around an axis of rotation; a first paddle mounted on the rotational shaft and configured to contact with a top of the supplied sheets on the processing section and move the sheets to a stopper and separate from the sheets by rotating with the rotational shaft for aligning the sheets; and a second paddle mounted on the rotational shaft at a predetermined angle with respect to the first paddle and configured to contact with the top of the sheets and move the sheets to the stopper by rotating with the rotational shaft for aligning the sheets after the first paddle is separated from the sheet.

In accordance with another embodiment, a sheet processing method involves receiving a plurality of sheets on a processing section; rotating a first paddle around an axis of rotation to contact with a top of the sheets on the processing section to draw the sheets into a stopper; and further drawing the sheet into the stopper after the first paddle is separated from the sheet using a second paddle mounted in the axis of rotation at a predetermined angle with respect to the first paddle.

Hereinafter, the sheet processing apparatus of the embodiment is described with reference to the accompanying drawings. Furthermore, in the following description, the same numerals are applied to configurations having identical or similar functions. Further, there is a case in which the repeated description of these configurations is omitted.

Figure 1:
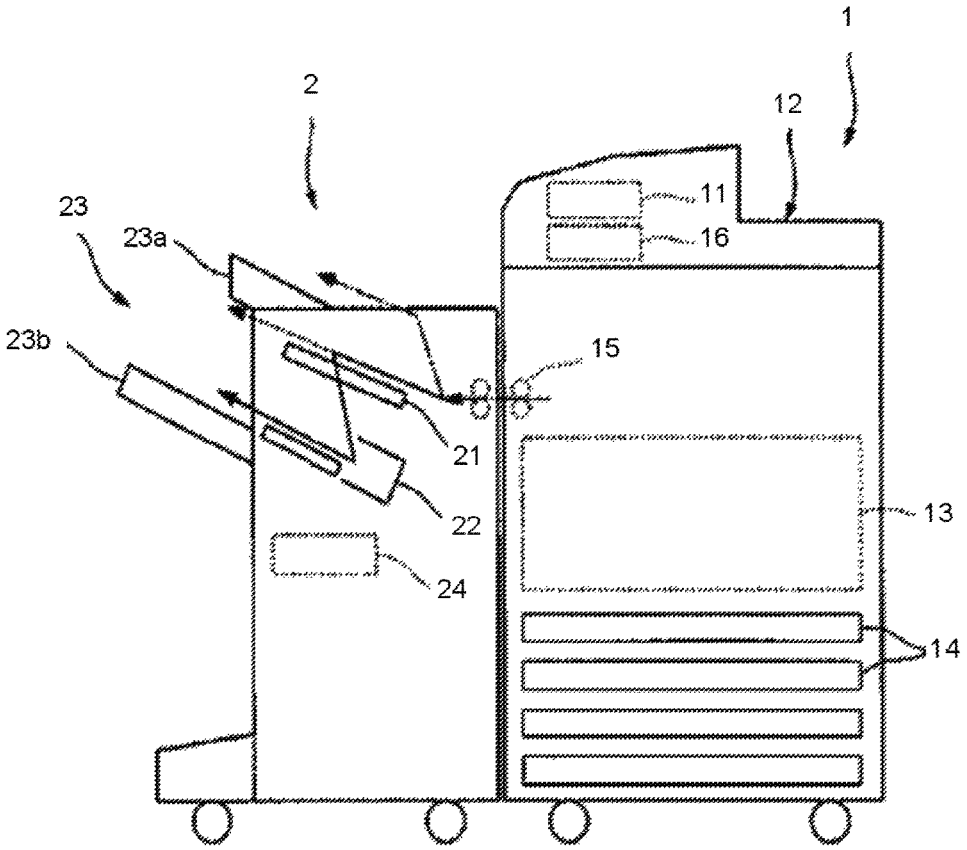
FIG. 1 is a diagram illustrating an image forming system according to an embodiment.
Figure 2:
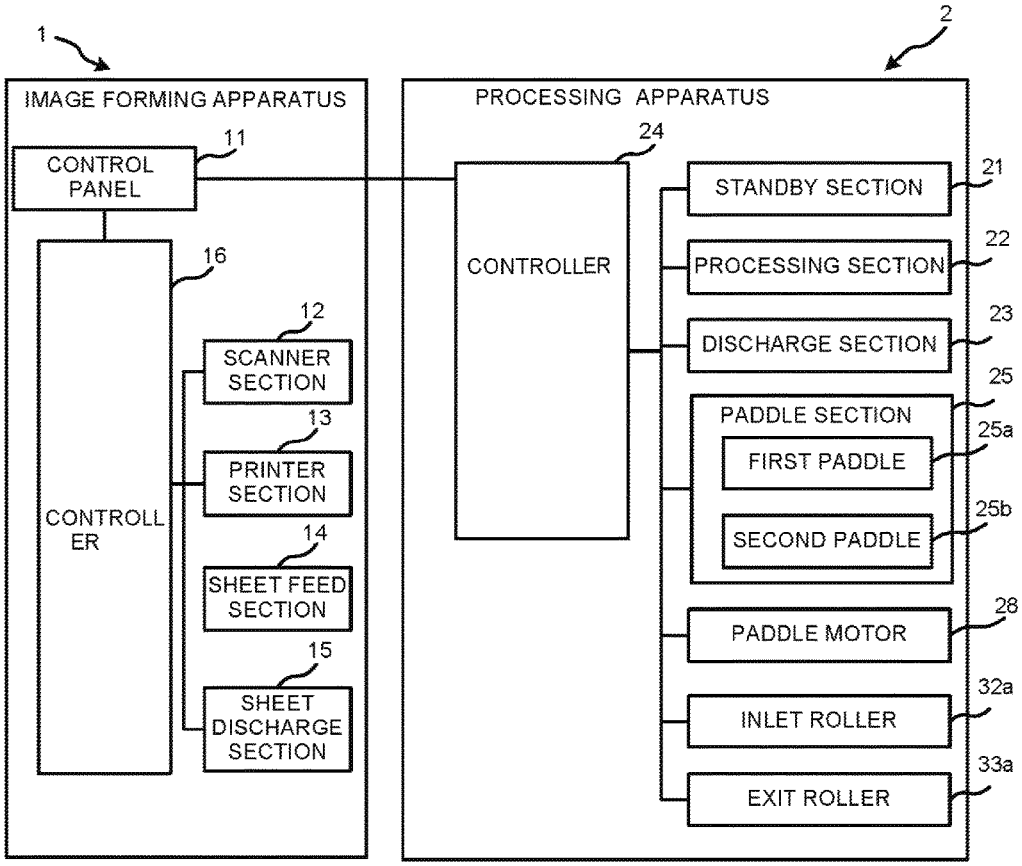
FIG. 2 is an electrical block diagram illustrating an image forming apparatus and a sheet processing apparatus according to the present embodiment.

The sheet processing apparatus of one embodiment is described with reference to FIG. 1 to FIG. 12. FIG. 1 is a diagram illustrating the entire configuration of an image forming system. FIG. 2 is an electrical block diagram illustrating an image forming apparatus and a sheet processing apparatus. The image forming system contains an image forming apparatus 1 and a sheet processing apparatus 2. The image forming apparatus 1 forms an image on a sheet-like medium (hereinafter, referred to as a "sheet") such as a paper. The sheet processing apparatus 2 carries out a post processing on a sheet conveyed from the image forming apparatus 1.

The image forming apparatus 1 shown in FIG. 1 includes a control panel 11, a scanner section 12, a printer section 13, a sheet feed section 14, a sheet discharge section 15 and an controller 16.

The control panel 11 has interface including various keys for receiving operations of a user. For example, the control panel 11 receives an input relating to a type of the post processing of the sheet. The control panel 11 sends information relating to the input type of the post processing to the sheet processing apparatus 2.

The scanner section 12 includes a reading section for reading image information of a copy object. The scanner section 12 sends the read image information to the printer section 13.

The printer section 13 forms an image (hereinafter, referred to as a "toner image") with a developing agent such as toner on the basis of the image information sent from the scanner section 12 or an external device. The printer section 13 transfers the toner image onto a surface of the sheet. The printer section 13 fixes the toner image by applying heat and pressure to the toner image transferred onto the sheet.

The sheet feed section 14 supplies the sheets one by one to the printer section 13. The sheet discharge section 15 conveys the sheet from the printer section 13 to the sheet processing apparatus 2.

As shown in FIG. 2, the controller 16 controls all operations of the image forming apparatus 1. In other words, the controller 16 controls the control panel 11, the scanner section 12, the printer section 13, the sheet feed section 14 and the sheet discharge section 15. The controller 16 is formed by a control circuit containing a CPU, a ROM and a RAM that are not shown.

Next, the configuration of the sheet processing apparatus 2 is described with reference to FIG. 1 and FIG. 2. As shown in FIG. 1, the sheet processing apparatus 2 is arranged adjacent to the image forming apparatus 1. The sheet processing apparatus 2 executes a post processing designated through the control panel 11 or the external device such as a client PC on the sheet conveyed from the image forming apparatus 1. For example, the post processing includes a stapling processing or a sorting processing.

The sheet processing apparatus 2 includes a standby section 21, a processing section 22, a discharge section 23 and a controller 24. The standby section 21 temporarily buffers a sheet S (refer to FIG. 3) conveyed from the image forming apparatus 1. For example, the standby section 21 enables a plurality of succeeding sheets S to stand by while the post processing on the preceding sheet S is carried out by the processing section 22. The standby section 21 is arranged above the processing section 22. The standby section 21 enables the buffered sheet S to drop towards the processing section 22 if the sheet in the processing section 22 is discharged to the discharge section 23.

The processing section 22 carries out the post processing on the sheet S. For example, the processing section 22 carries out the stapling processing on a plurality of the aligned sheets S. In this way, a plurality of the sheets S is bound together by staples. The processing section 22 discharges the sheet S to which the post processing is carried out to the discharge section 23.

The discharge section 23 includes a fixed tray 23*a* and a movable tray 23*b*. The fixed tray 23*a* is arranged on the upper part of the sheet processing apparatus 2. The movable tray 23*b* is arranged on the side of the sheet processing apparatus 2. The sheet S to which the stapling processing or the sorting processing is carried out is discharged to the movable tray 23*b*.

As shown in FIG. 2, the controller 24 controls all operations of the sheet processing apparatus 2. In other words, the controller 24 controls the standby section 21, the processing section 22 and the discharge section 23. Further, as shown in FIG. 2, the controller 24 controls an inlet roller 32*a*, an exit roller 33*a*, a paddle section 25 and a paddle motor 28. The controller 24 includes a control circuit containing a CPU, a ROM and a RAM that are not shown.

Figure 3:
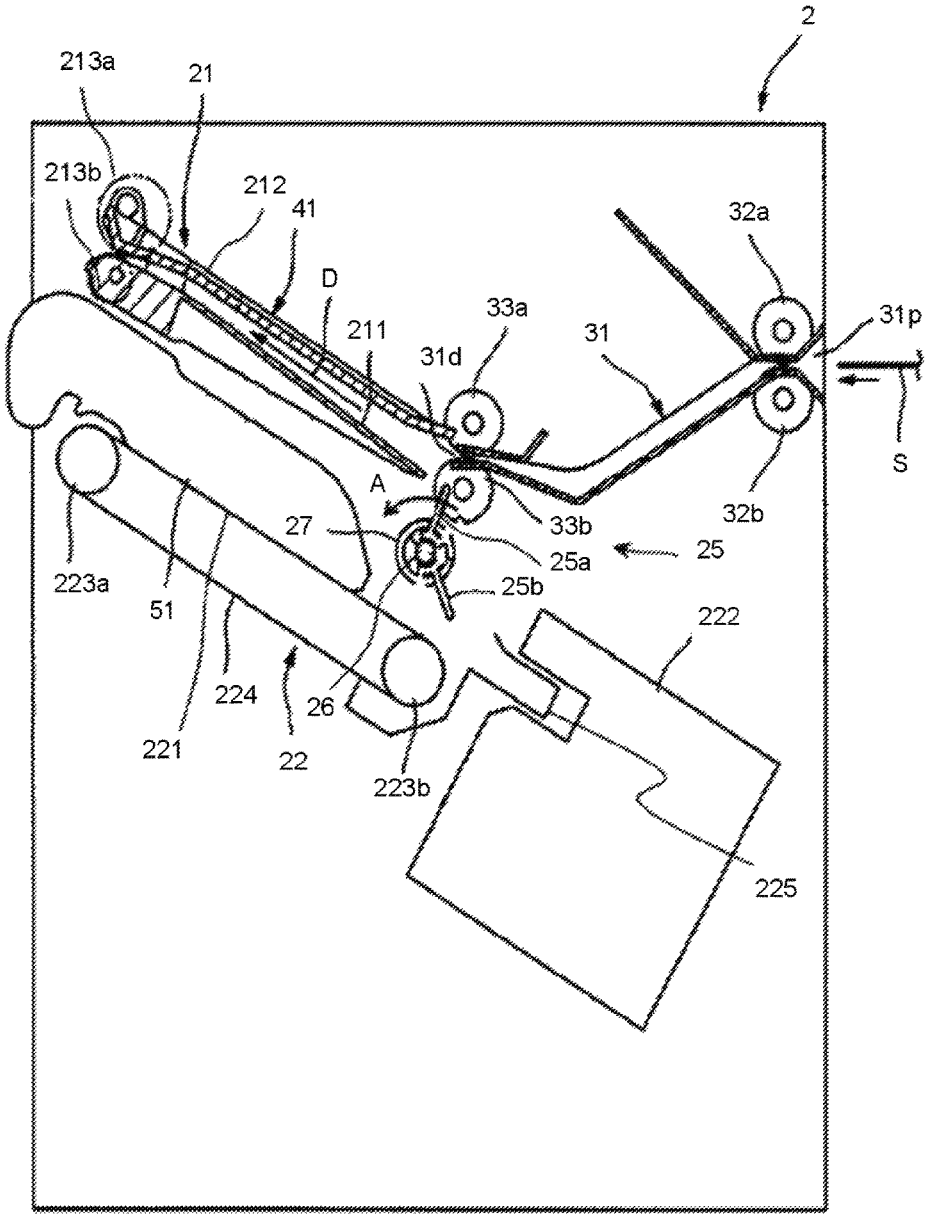
FIG. 3 is a diagram schematically illustrating details of the configuration of each section of the sheet processing apparatus according to the present embodiment.

FIG. 3 illustrates a configuration of the sheet processing apparatus 2. Furthermore, a "sheet conveyance direction" described in the present embodiment refers to a conveyance direction D of the sheet S to the standby tray 211 of the standby section 21 (an approach direction of the sheet S to a standby tray 211) or a direction in which the sheet S is conveyed from a processing tray 221 to the movable tray 23*b*.

Further, an "upstream side" and a "downstream side" described in the present embodiment respectively refer to the upstream side and the downstream side in the sheet conveyance direction D. Further, a "front end part" and a "back end part" described in the present embodiment respectively refer to "the end part of the downstream side" and "the end part of the upstream side" in the sheet conveyance direction D. In the present embodiment, a direction orthogonal to the sheet conveyance direction D is referred to as a sheet width direction W.

Hereinafter, the details of the configuration of each section of the sheet processing apparatus 2 are described based on FIG. 3. A conveyance path 31 is a conveyance path from a sheet supply port 31*p* to a sheet discharge port 31*d*. The sheet supply port 31*p* is arranged at a position facing the image forming apparatus 1. The sheet S is supplied from the image forming apparatus 1 to the sheet supply port 31*p*. On the other hand, the sheet discharge port 31*d* is located in the vicinity of the standby section 21. The sheet S discharged from the image forming apparatus 1 is discharged to the standby section 21 via the conveyance path 31.

The inlet rollers 32*a* and 32*b* are arranged in the vicinity of the sheet supply port 31*p*. The inlet rollers 32*a* and 32*b* convey the sheet S supplied to the sheet supply port 31*p* towards the downstream side of the conveyance path 31. For example, the inlet rollers 32*a* and 32*b* convey the sheet S supplied to the sheet supply port 31*p* to the exit rollers 33*a* and 33*b*.

The exit rollers 33*a* and 33*b* are arranged in the vicinity of the sheet discharge port 31*d*. The exit rollers 33*a* and 33*b* receive the sheet S conveyed by the inlet rollers 32*a* and 32*b*. The exit rollers 33*a* and 33*b* convey the sheet S from the sheet discharge port 31*d* to the standby section 21.

The standby section 21 includes the standby tray (buffer tray) 211, a conveyance guide 212, discharge rollers 213*a* and 213*b* and an opening and closing driving section (not shown).

The back end part of the standby tray 211 is located in the vicinity of the exit rollers 33*a* and 33*b*. The back end part of the standby tray 211 is located slightly below the sheet discharge port 31*d* of the conveyance path 31. The standby tray 211 is inclined with respect to the horizontal direction in such a way as to gradually rise towards the downstream side of the sheet conveyance direction D. The standby tray 211 stacks a plurality of the sheets S to enable them to stand by while the post processing is carried out by the processing section 22.

Figure 4:
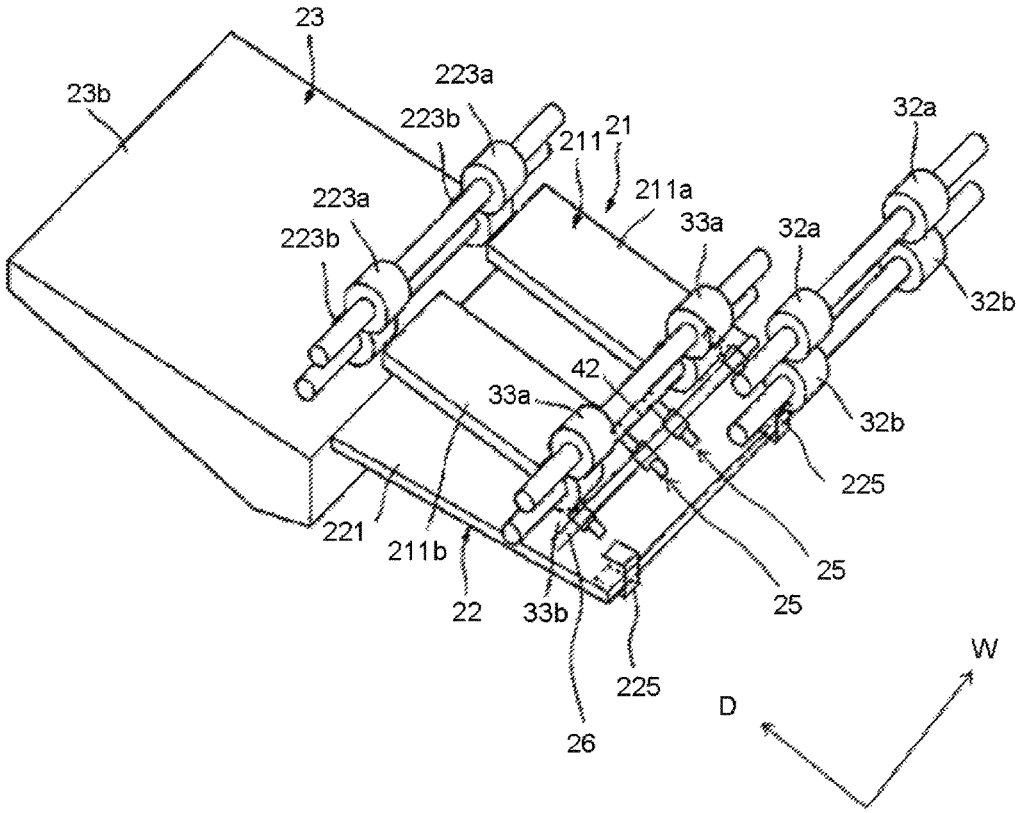
FIG. 4 is a diagram schematically illustrating a relation between a standby tray and a paddle section according to the present embodiment.

FIG. 4 illustrates a relation between the standby tray 211 and the paddle section 25 described later. As shown in FIG. 4, the standby tray 211 includes a first tray member 211*a* and a second tray member 211*b*. The first tray member 211*a* and the second tray member 211*b* are separated from each other in a sheet width direction W. The first tray member 211*a* and the second tray member 211*b* is driven by the opening and closing driving section and move in a mutually approaching direction and in a mutually separating direction.

The first tray member 211*a* and the second tray member 211*b* support the sheet S conveyed from the exit rollers 33*a* and 33*b* in a state in which the first tray member 211*a* and the second tray member 211*b* approach each other. On the other hand, the first tray member 211*a* and the second tray member 211*b* are separated in the mutually separating direction in the sheet width direction W to enable the sheet S to move from the standby tray 211 towards the processing tray 221. In this way, the sheet S supported by the standby tray 211 drops from a space between the first tray member 211*a* and the second tray member 211*b* towards the processing tray 221. In other words, the sheet S moves from the standby tray 211 to the processing tray 221.

An assist arm 41 shown in FIG. 3 is arranged above the standby tray 211. For example, the length of the assist arm 41 is approximately half or more of that of the standby tray 211 in the sheet conveyance direction D. In the present embodiment, the assist arm 41 has the approximately same length as the standby tray 211 in the sheet conveyance direction D. The assist arm 41 is a plate-like member extending upwards the standby tray 211. The sheet S discharged from the exit rollers 33*a* and 33*b* enters into the space between the assist arm 41 and the standby tray 211.

The processing section 22 shown in FIG. 3 includes the processing tray 221, a stapler 222, conveyance rollers 223*a* and 223*b*, and a conveyance belt 224, a stopper 225 and a horizontal alignment plate 51.

The processing tray 221 is arranged below the standby tray 211. The processing tray 221 is inclined with respect to the horizontal direction in such a way as to gradually rise towards the downstream side of the sheet conveyance direction D. The processing tray 221 is inclined approximately parallel to the standby tray 211. As for a plurality of sheets S moved to the processing tray 221, deviation between the sheets S in the sheet width direction W is aligned by the horizontal alignment plate 51.

The stapler 222 is arranged at an end part of the processing tray 221. The stapler 222 carries out a stapling (binding) processing on a bundle of the predetermined number of sheets S located on the processing tray 221.

The conveyance rollers 223*a* and 223*b* are arranged at a predetermined interval in the sheet conveyance direction D. The conveyance belt 224 is stretched over the conveyance rollers 223*a* and 223*b*. The conveyance belt 224 is rotated in synchronization with the conveyance rollers 223*a* and 223*b*. The conveyance belt 224 conveys the sheet S between the stapler 222 and the discharge section 23.

The stopper 225 is arranged at the upstream side of the sheet conveyance direction when viewed from the conveyance roller 223*b*. The stopper 225 is a member for receiving an end of the sheets S moved from the standby tray 211 to the processing tray 221 to align them in the sheet conveyance direction. In other words, the stopper 225 is a member serving as a sheet reference position when an alignment processing in the sheet conveyance direction is executed. In other words, the sheets S moved towards the upstream side of the sheet conveyance direction through a first paddle 25*a* and a second paddle 25*b* described later are struck against the stopper 225 to be aligned in the sheet conveyance direction. Hereinafter, aligning the sheets in the sheet conveyance direction is referred to as a vertical alignment processing.

The paddle section 25 shown in FIG. 3 includes the first paddle 25*a*, the second paddle 25*b*, a rotational shaft 26 and a rotating body 27.

The rotational shaft 26 rotates around an axis of rotation. The axis of rotation is a rotation center of the first paddle 25*a* and the second paddle 25*b* described later. The rotational shaft 26 is located below the standby tray 211. The rotational shaft 26 extends in the sheet width direction W. The rotational shaft 26 receives driving force from the paddle motor 28 to rotate in an arrow A direction (in a counter-clockwise direction) in FIG. 3.

Figure 5:
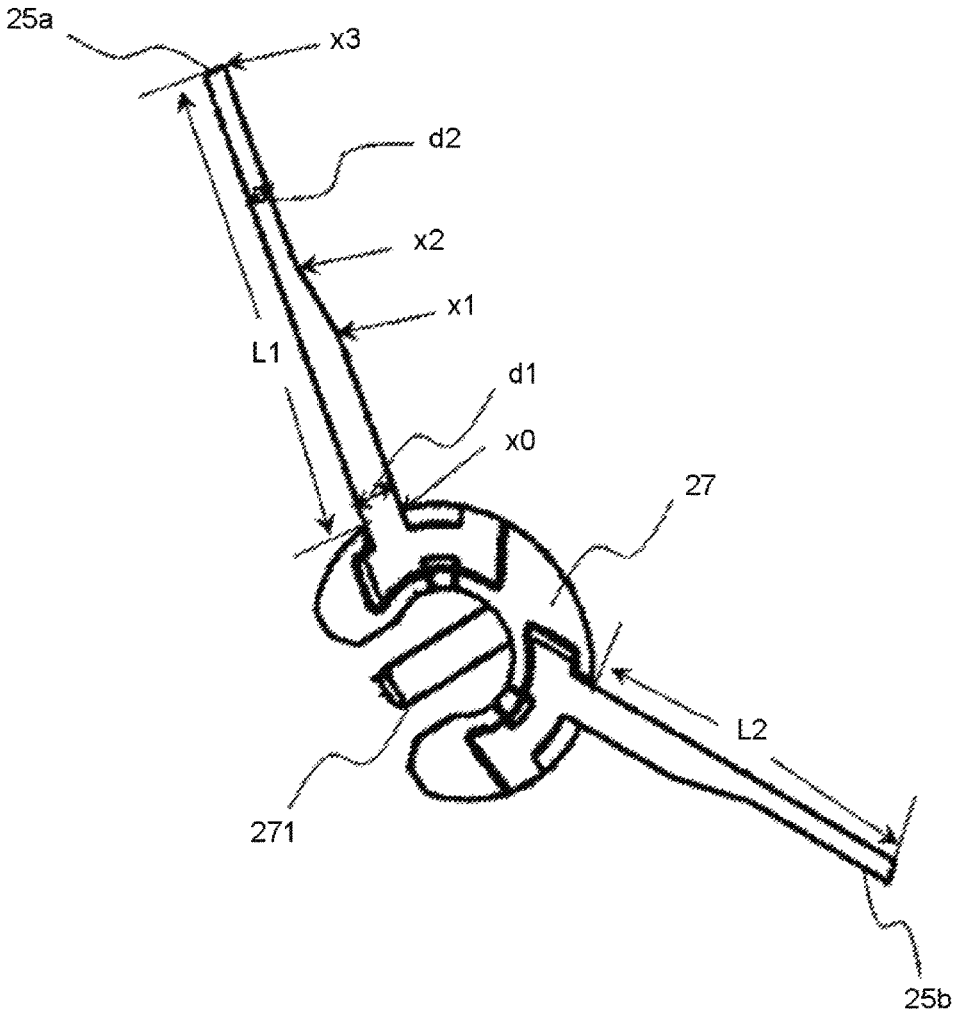
FIG. 5 is a diagram illustrating the paddle section according to the present embodiment.

FIG. 5 is a diagram illustrating the detailed configuration of the paddle section 25. The paddle section 25 includes the first paddle 25*a*, the second paddle 25*b* and the rotating body 27.

The rotating body 27 is a cylindrical shape with a part of region missed. The rotating body 27 includes a protrusion 271. The protrusion 271 is fitted into a groove preset in the rotational shaft 26 to be detachably mounted in the rotational shaft 26. If the rotational shaft 26 rotates in the rotation direction A (in the counter-clockwise direction) in FIG. 3, the rotating body 27 is also rotated integrally in the same direction. Further, as the first paddle 25*a* and the second paddle 25*b* are mounted in the rotating body 27, if the rotational shaft 26 is rotated in the arrow A direction in FIG. 3, the first paddle 25*a* and the second paddle 25*b* are rotated in the counter-clockwise direction together with the rotating body 27.

Figure 7:
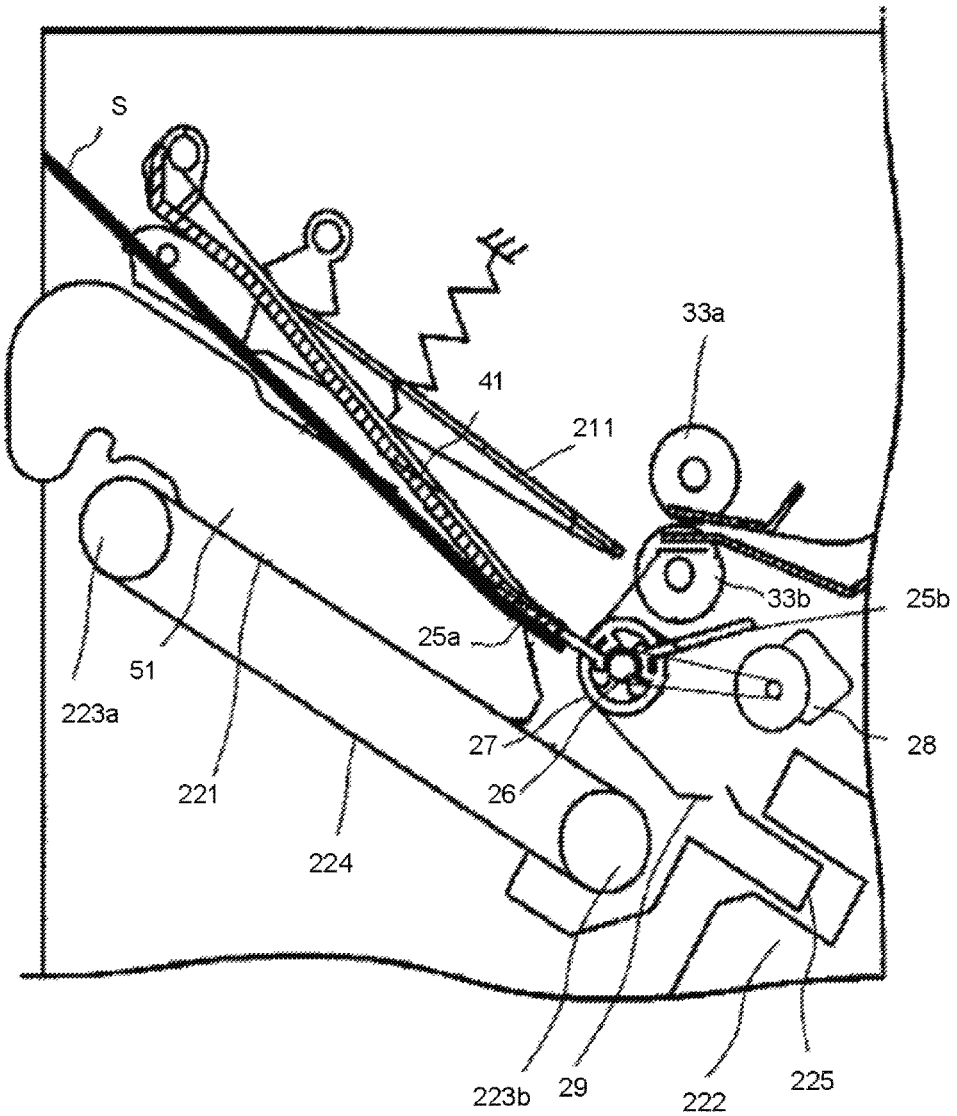
FIG. 7 is a diagram illustrating a sheet moving processing by the first paddle according to the present embodiment.
Figure 8:
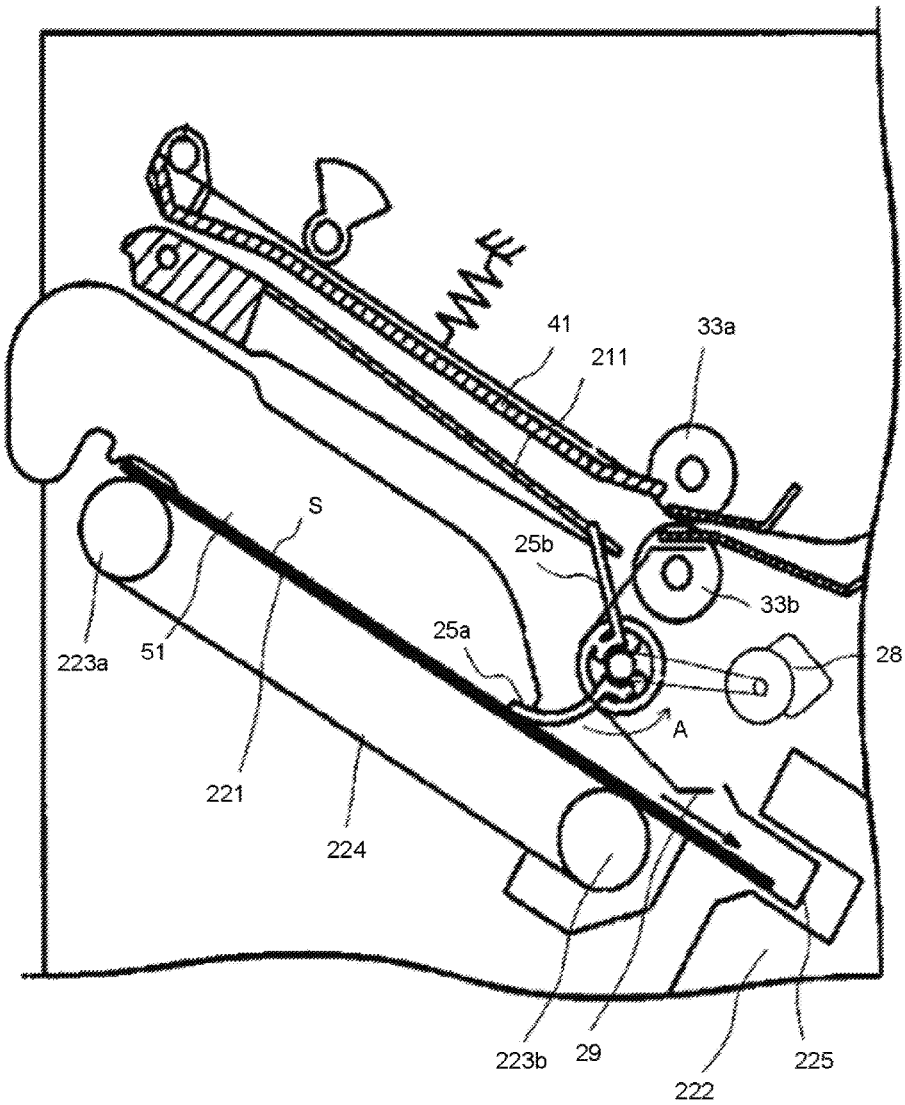
FIG. 8 is a diagram illustrating a vertical alignment processing by the first paddle according to the present embodiment.

The first paddle 25*a* and the second paddle 25*b* are formed with an elastic material such as rubber or resin. The first paddle 25*a* protrudes to the diameter direction of the rotating body 27 to be mounted in the rotating body 27. The first paddle 25*a* has a length L1 in the diameter direction of the rotating body 27. The first paddle 25*a* has a shape in which a thickness d1 at the mounting position to the rotating body 27 is different from a thickness d2 of the front end of the paddle. In detail, the first paddle 25*a* has the thickness d1 in a region from the mounting position x0 to the rotating body 27 to a position x1 protruding in the diameter direction of the rotating body 27. The first paddle 25*a* has a shape in which the thickness d1 is gradually decreased towards the position x2 in the region from the position x1 to the position x2. The first paddle 25*a* has the thickness d2 (<d1) in the region from the position x2 to the position x3. The first paddle 25*a* ensures the strength thereof due to the thickness d1 between the position X0 and the position X1. By contrast, a noise generated by contact of the first paddle 25*a* against the sheet supported by the stand-by tray 211 (as shown in FIG. 7) is reduced due to the thickness d2 thinner than d1 between the position X2 and the position X3. Furthermore, a noise generated by contact of the first paddle 25*a* against the sheet supported by the processing tray 221 (as shown in FIG. 8) is reduced due to the thickness d2 thinner than d1 between the position X2 and the position X3.

As shown in FIG. 5, the second paddle 25*b* is arranged to have a predetermined angle with respect to the first paddle 25*a*. In other words, the second paddle 25*b* is arranged to have a predetermined distance away from the rear of the first paddle 25*a* in the rotation direction A in FIG. 3. In one embodiment, the predetermined angle is from 5 degrees to 355 degrees. In another embodiment, the predetermined angle is from 10 degrees to 180 degrees. In yet another embodiment, the predetermined angle is from 90 degrees to 170 degrees.

The second paddle 25*b* protrudes to the diameter direction of the rotating body 27 to be amounted in the rotating body 27. The second paddle 25*b* has a length L2 shorter than the length L1 of the first paddle 25*a* in the diameter direction of the rotating body 27. Further, the second paddle 25*b* has a shape in which the thickness d1 at the mounting position to the rotating body 27 is thicker than the thickness d2 of the front end of the paddle, which is identical to the first paddle 25*a*. The shape of the second paddle 25*b* is identical to that of the first paddle 25*a*, and thus the description thereof is omitted.

A series of operations of the first paddle 25*a* and the second paddle 25*b* is described with reference to FIG. 6 to FIG. 12.

Figure 6:
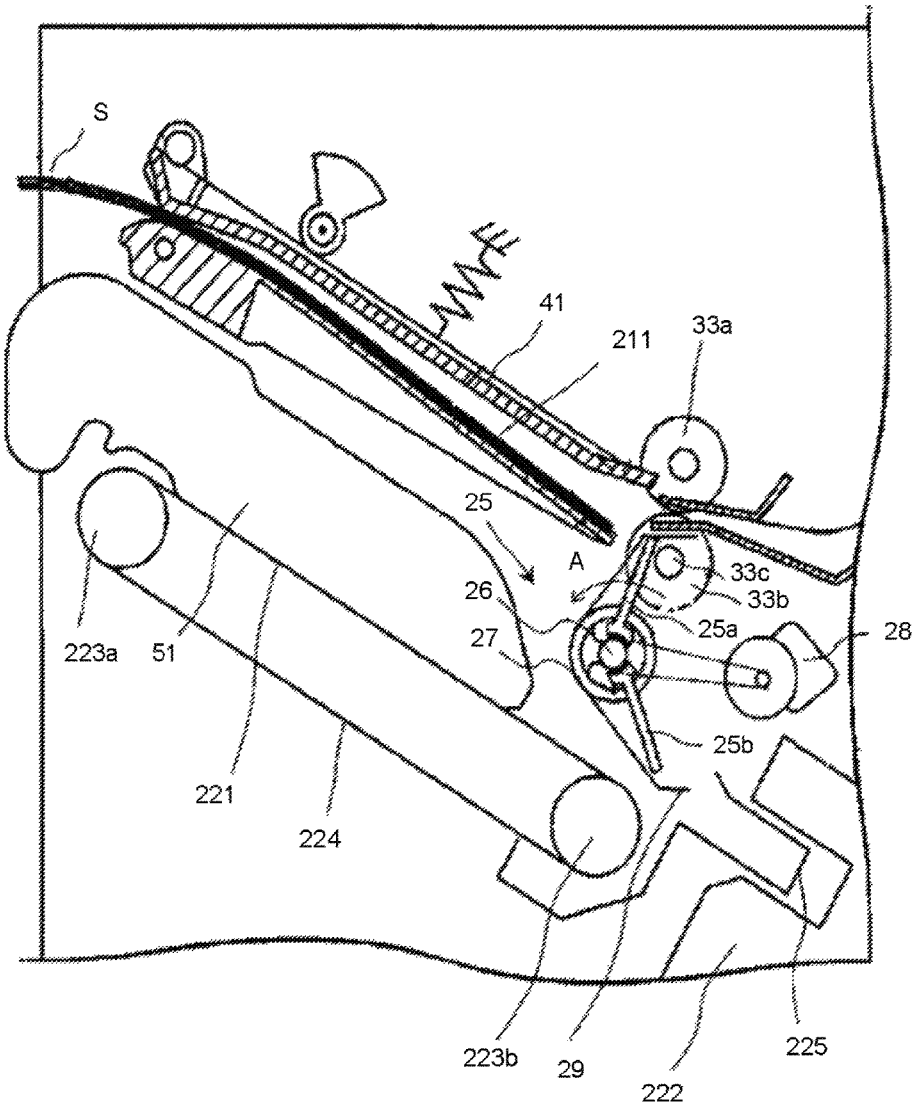
FIG. 6 is a diagram illustrating standby positions of a first paddle and a second paddle according to the present embodiment.

FIG. 6 is a diagram illustrating standby positions before the first paddle 25*a* and the second paddle 25*b* are driven to rotate. The "standby positions" refer to positions at which the first paddle 25*a* and the second paddle 25*b* stand by when the sheet S is conveyed from the exit rollers 33*a* and 33*b* towards the standby tray 211 to be stacked or the sheet S is directly conveyed from the exit rollers 33*a* and 33*b* to the processing tray 221. In other words, the "standby positions" refer to the positions where the first paddle 25*a* and the second paddle 25*b* wait when the first paddle 25*a* and the second paddle 25*b* do not carry out the vertical alignment processing on the sheets.

In FIG. 6, the first paddle 25*a* is arranged at a position at which the first paddle 25*a* does not protrude towards the downstream side of the sheet conveyance direction D with respect to the outer peripheral surface of the exit roller 33*b* when viewed from an axis 33*c* of the exit roller 33*b*. From a different point of view, when viewed from the standby tray 211, the first paddle 25*a* is located at the upstream side of the conveyance direction with respect to the outer peripheral surface of the exit roller 33*b* located in the vicinity of the standby tray 211 and is arranged at a position at which the conveyance of the sheet S conveyed from the exit roller 33*b* to the standby tray 211 is not disturbed. The second paddle 25*b* is arranged at a position at which the front end part thereof is apart from the sheets S on the processing tray 221 at only a predetermined distance.

FIG. 7 illustrates a state in which the first paddle 25*a* contacts with the sheet S to be moved from the standby tray 211 to the processing tray 221. If the predetermined number of sheets S is stacked on the standby tray 211, the controller 24 drives a pair of the standby tray members 211*a* and 211*b* in the mutually separating direction in the sheet width direction W to move the buffered sheets S to the processing tray 221.

The controller 24 drives the paddle motor 28 to rotate the rotational shaft 26. The first paddle 25*a* is rotated with the rotation of the rotational shaft 26 and contact with the sheet S dropped from the standby tray 211. Then the first paddle 25*a* forces the sheets S towards the processing tray 221.

FIG. 8 illustrates an operation of the vertical alignment processing to the sheets S on the processing tray 221 by the first paddle 25*a* through the further rotation of the first paddle 25*a* in the arrow A direction (in the counter-clockwise direction).

The first paddle 25*a* is further rotated in the arrow A direction to guide the sheet S onto the processing tray 221 and contacts with the processing tray 221 across the sheet S to become a bent state (refer to FIG. 8) from the state shown in FIG. 7. The first paddle 25*a* is rotated in the arrow A direction to be kept in the bent state and moves the sheet S towards the stopper 225 located at the upstream side of the sheet conveyance direction from the processing tray 221. In other words, the first paddle 25*a* sandwiches a plurality of the sheets S together with the processing tray 221 and draws the sheets S into the stopper 225 to carry out the vertical alignment processing.

Figure 9:
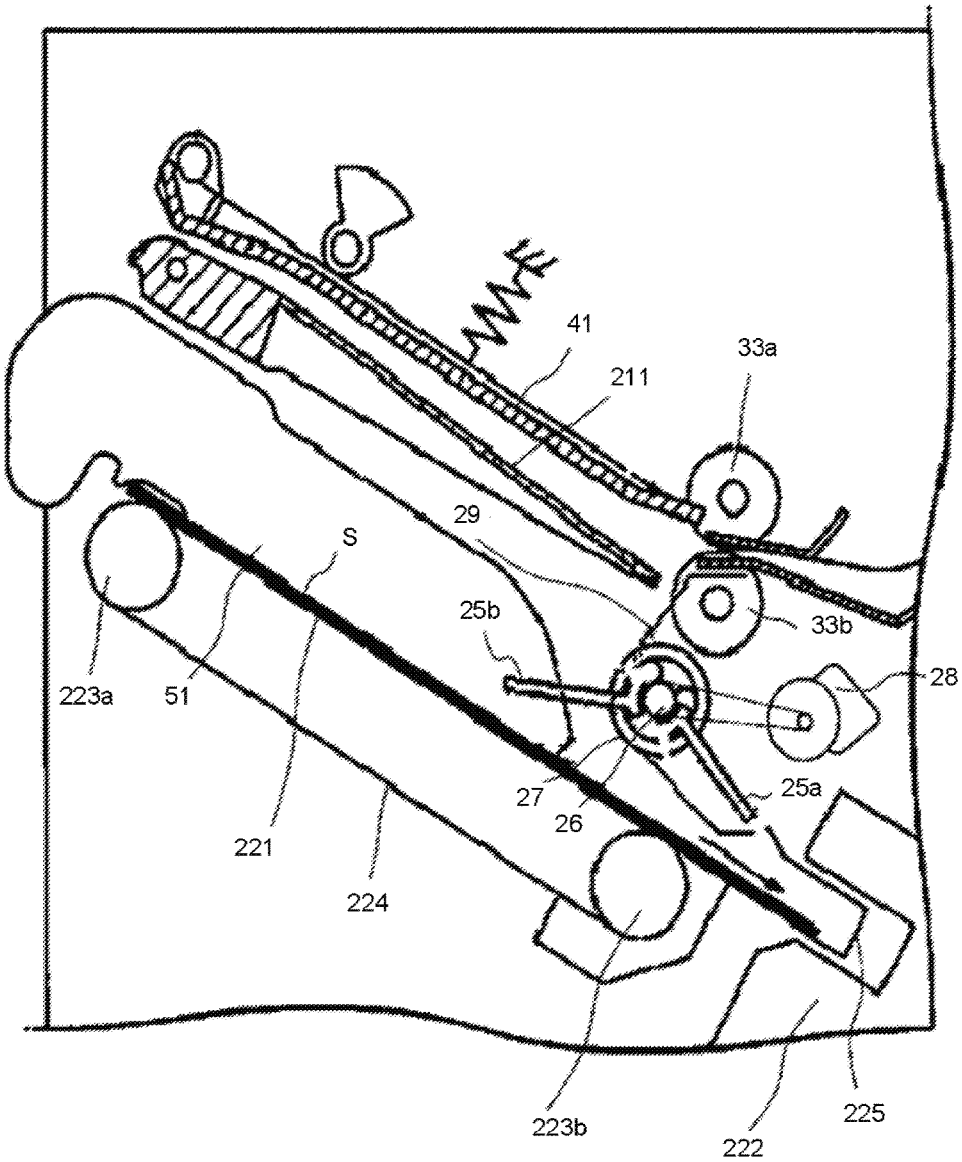
FIG. 9 is a diagram illustrating stop positions of the first paddle and the second paddle according to the present embodiment.

FIG. 9 illustrates states of the first paddle 25*a* and the second paddle 25*b* after the vertical alignment processing on the sheets S by the first paddle 25*a* shown in FIG. 8.

The controller 24 controls rotation of the rotational shaft 26 to suspend the first paddle 25*a* and the second paddle 25*b* after the first paddle 25*a* separates from the sheets and before the second paddle 25*b* contacts with the sheets. The controller 24 controls the paddle motor 28 to stop the rotation of the rotational shaft 26 if the first paddle 25*a* arrives at a position away from the sheets S on the processing tray 221 after the first paddle 25*a* executes the vertical alignment processing on the sheets S. In this way, the rotation of the first paddle 25*a* and the second paddle 25*b* is stopped. The second paddle 25*b* is stopped in such a way as to be positioned at the position away from the sheets S on the processing tray 221 at only the predetermined distance. In other words, after the vertical alignment processing on the sheets S is carried out by the first paddle 25*a*, the first paddle 25*a* and the second paddle 25*b* are controlled to stop the rotation operation thereof in such a way as to be respectively positioned at the positions away from the sheets S on the processing tray 221 at only the predetermined distance.

The reason why the first paddle 25*a* and the second paddle 25*b* are stopped at the positions away from the sheets S on the processing tray 221 at only the predetermined distance is described as follows. After the vertical alignment processing is carried out on the sheets S by the first paddle 25*a*, a processing (horizontal alignment processing) of aligning the end parts of the width direction of the sheets in the sheet width direction W is executed by the horizontal alignment plate 51. At the time of the horizontal alignment processing, if the first paddle 25*a* or the second paddle 25*b* contacts with the sheet S, the processing (horizontal alignment processing) of aligning the end parts of the width direction of the sheets is disturbed, and thus the first paddle 25*a* and the second paddle 25*b* are separated from the sheet S.

Figure 10:
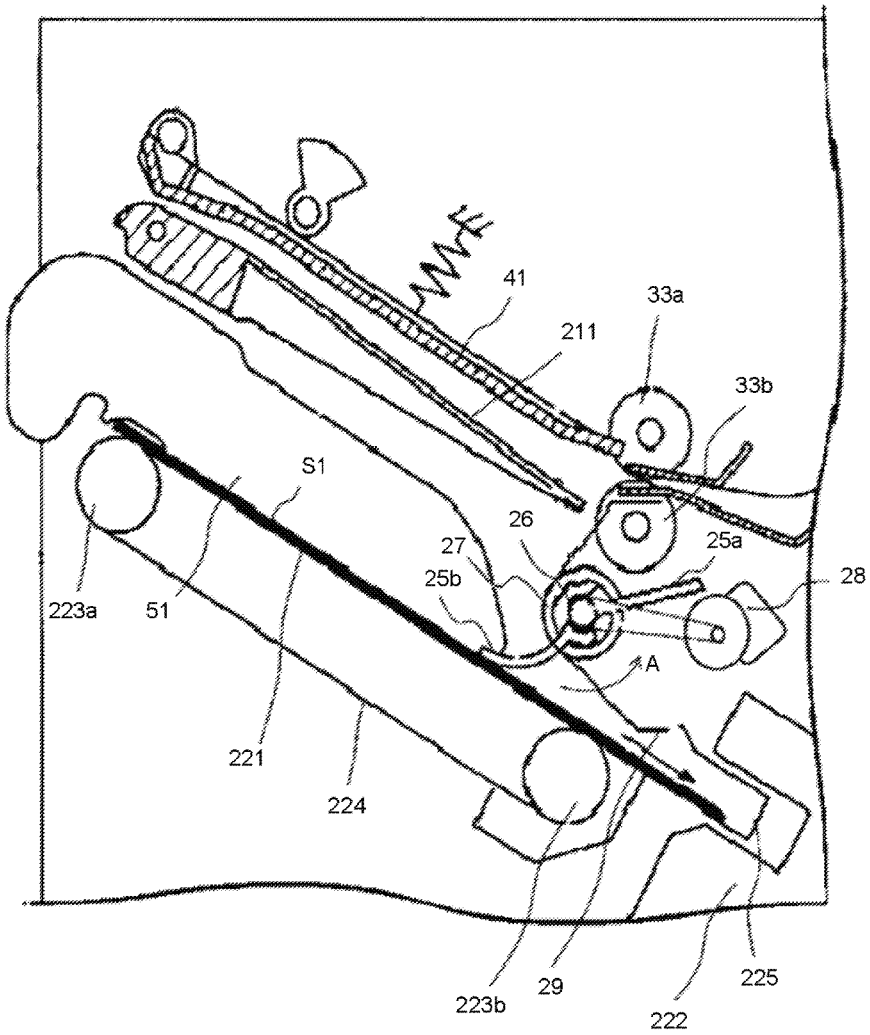
FIG. 10 is a diagram illustrating a vertical alignment processing by the second paddle according to the present embodiment.

FIG. 10 illustrates the operation of the vertical alignment processing of the sheets S by the second paddle 25*b*. The controller 24 controls the drive of the paddle motor 28 to rotate the first paddle 25*a* and the second paddle 25*b* again in the arrow A direction. The first paddle 25*a* and the second paddle 25*b* receive the drive force of the paddle motor 28 to rotate in the counter-clockwise direction.

Hereinafter, the second paddle 25*b* is concentratedly described. The second paddle 25*b* contacts with the sheet S and sandwiches the sheet S with the processing tray 221 in the bent state to carry out a drawing-in operation towards the stopper 225.

The reason why the vertical alignment processing is further carried out through the second paddle 25*b* is described as follows. When the first paddle 25*a* draws the sheet S into the stopper 225, there is a case in which a drawing-in quantity of the sheets S becomes excessive. The drawing-in quantity of the sheets amounts to a force to slide a sheet on the processing tray 211 towards to the stopper 225 by the first paddle 25*a* or the second paddle 25*b*. In this case, the sheets S strike against the stopper 225 and move towards the sheet conveyance direction D through repulsive force, and there is a possibility that the alignment of the sheets S in the sheet conveyance direction cannot be executed with high accuracy. Thus, after the first paddle 25*a* carries out the drawing-in operation of the sheet S, the second paddle 25*b* carries out the drawing-in operation again to execute the vertical alignment processing again on the sheets S to which the vertical alignment processing cannot be sufficiently carried out by the first paddle 25*a*, and it is possible to improve aligning property in the sheet conveyance direction. While the first paddle 25*a* makes one rotation, it is possible to execute the vertical alignment processing twice by the first paddle 25*a* and the second paddle 25*b*, which contributes to the high speed of the sheet processing without the need of rotating the paddle section for many times.

Furthermore, the drawing-in quantity of the sheets S by the second paddle 25*b* may be smaller than that by the first paddle 25*a* because the first paddle 25*a* has already executed the vertical alignment processing before the second paddle 25*b* contact with the sheet on the processing tray 221.

For example, the length L2 of the second paddle 25*b* may be shorter than the length L1 of the first paddle 25*a* as stated above. Hereby, the area where the sheets S and the second paddle 25*b* contact with each other is smaller than the area where the sheets S and the first paddle 25*a* contact with each other. Therefore, it is possible that the drawing-in quantity of the sheets S by the second paddle 25*b* is smaller than that of the sheets S by the first paddle 25*a*.

Furthermore, in one embodiment the Young's modulus of materials of the second paddle 25*b* may be smaller than that of the first paddle 25*a* so that the stress generated due to the bend of the second paddle 25*b* is smaller than that generated due to the bend of the first paddle 25*a*. Also, as for the hardness of the first paddle 25*a* and the second paddle 25*b*, in one embodiment the second paddle 25*b* may be softer than the first paddle 25*a*. Further, as for the relation between the thicknesses of the first paddle 25*a* and the second paddle 25*b*, in one embodiment the second paddle 25*b* may be thinner than the first paddle 25*a*. Particularly, it is preferable that apart of second paddle 25*b* where the second paddle 25*b* contact with the sheet on the processing tray 221 is thinner than a part of the first paddle 25*a* where the first paddle 25*a* contact with the sheet on the processing tray 221.

Figure 11:
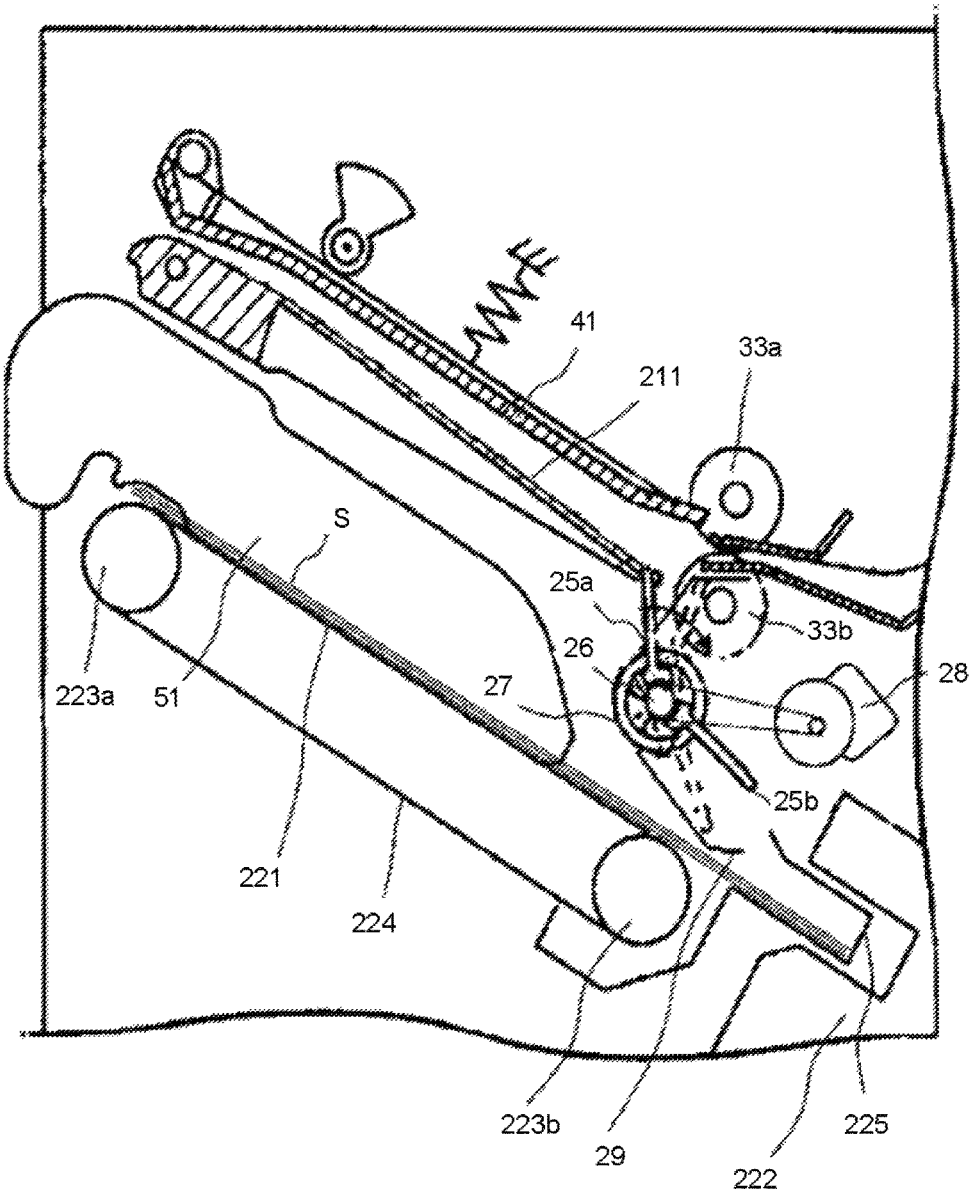
FIG. 11 is a diagram illustrating a state after the vertical alignment processing is completed by the first paddle and the second paddle according to the present embodiment.

FIG. 11 is a diagram illustrating a state after the vertical alignment processing is completed by the first paddle 25*a* and the second paddle 25*b*.

After the vertical alignment processing is executed by the second paddle 25*b*, the first paddle 25*a* and the second paddle 25*b* stop after rotating to the positions indicated by solid lines in FIG. 11. Dotted lines shown in FIG. 11 indicate the standby positions of the first paddle 25*a* and the second paddle 25*b* shown in FIG. 6. The controller 24 rotates the first paddle 25*a* and the second paddle 25*b* to the positions (positions indicated by the solid lines) exceeding the standby positions after the vertical alignment processing by the second paddle 25*b* to certainly separate the second paddle 25*b* after the vertical alignment processing from the sheets S on the processing tray 221. In this way, the second paddle 25*b* stops in a state where it contacts with the sheets S on the processing tray 221, and it is suppressed that a negative influence is applied to the sheet aligning properties at the time succeeding sheets are conveyed to the processing tray.

Then, the controller 24 controls the paddle motor 28 to rotate in a direction (in a clockwise direction) opposite to the arrow A direction and positions the first paddle 25*a* and the second paddle 25*b* at the standby positions.

Figure 12:
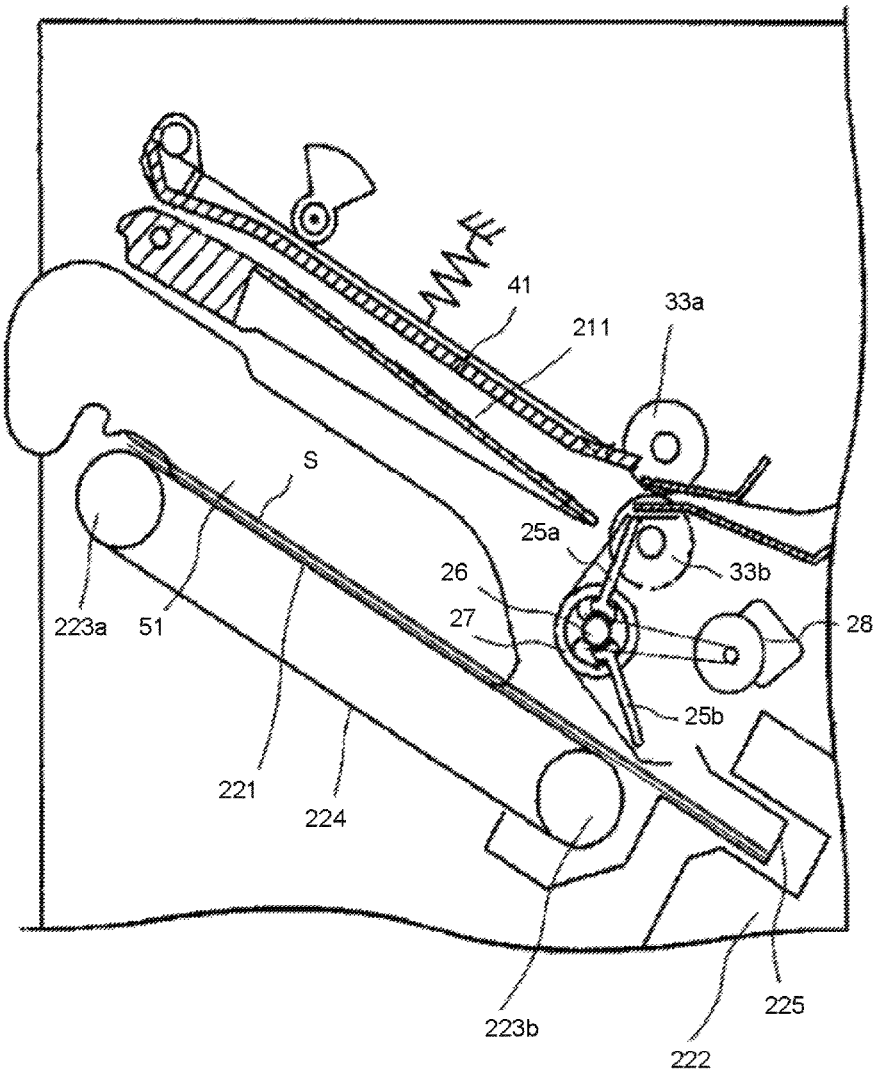
FIG. 12 is a diagram illustrating the standby positions of the first paddle and the second paddle after the vertical alignment processing according to the present embodiment.

FIG. 12 is a diagram illustrating a state where the first paddle 25*a* and the second paddle 25*b* return to the standby positions. The first paddle 25*a* and the second paddle 25*b* wait for that the succeeding sheets are received by the standby tray 211 in a state where they are located at the standby positions.

Through the above, according to the present embodiment, the following effects are obtained. As the first paddle 25*a* and the second paddle 25*b* draw the sheets on the processing tray into the stopper to carry out the vertical alignment processing, it is possible to realize the high speed of the processing and improve the sheet aligning properties in the sheet conveyance direction.

The drawing-in operation of the sheet S to the stopper 225 by the first paddle 25*a* and the second paddle 25*b* is executed while the first paddle 25*a* makes one rotation around the rotational shaft 26. Thus, it contributes to the high speed of the sheet processing without the need of rotating the first paddle 25*a* for many times in order to improve the sheet aligning properties.

As the second paddle 25*b* carries out the drawing-in operation of the sheet again after the first paddle 25*a* is separated from the sheet after the first paddle 25*a* completes the drawing-in operation of the sheets on the processing tray, even if the vertical alignment processing carried out by the first paddle 25*a* is not sufficient, it is possible to align the sheets in the sheet conveyance direction with high accuracy.

After the drawing-in operation of the sheet S carried out by the first paddle 25*a*, the controller 24 controls the rotation of the first paddle 25*a* and the second paddle 25*b* to enable the first paddle 25*a* and the second paddle 25*b* to stop at the positions respectively separated from the sheets S on the processing tray, and thus the disturbance of the processing (horizontal alignment processing) of aligning the end parts of the sheets in the sheet width direction W by the horizontal alignment plate 51 later can be suppressed.

As the first paddle 25*a* is located at the position where the first paddle 25*a* does not disturb the sheet conveyance in the standby position after the vertical alignment processing by the second paddle 25*b* and the second paddle 25*b* is located at the position where the second paddle 25*b* does not contact with the sheets S on the processing tray 221, the following effects are realized: the sheet conveyance to the processing tray of the succeeding sheets is not disturbed and the alignment of the sheets is not disarranged.

Further, as the first paddle 25*a* and the second paddle 25*b* are constituted in such a manner that the drawing-in quantity of the sheets by the second paddle 25*b* is smaller than that of the sheets by the first paddle 25*a*, it is possible to improve the accuracy of the sheet aligning properties. Specifically, as the second paddle 25*b* is constituted by the member with a shorter length than the first paddle 25*a*, the drawing-in quantity of the sheets by the second paddle 25*b* can be smaller than that of the sheets by the first paddle 25*a*, and it is possible to improve the accuracy of the sheet aligning properties.

With respect to any figure or numerical range for a given characteristic, a figure or a parameter from one range may be combined with another figure or a parameter from a different range for the same characteristic to generate a numerical range.

Other than in the operating examples, or where otherwise indicated, all numbers, values and/or expressions referring to quantities of ingredients, reaction conditions, etc., used in the specification and claims are to be understood as modified in all instances by the term "about."

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A sheet processing apparatus, comprising:

a standby section configured to buffer a sheet;

a processing section configured to receive sheets supplied from the standby section and execute a post processing on the sheets;

a rotational shaft configured to rotate around an axis of rotation;

a first paddle mounted on the rotational shaft and configured to contact with a top of the supplied sheets on the processing section and move the sheets to a stopper and separate from the sheets by rotating with the rotational shaft for aligning the sheets; and a second paddle mounted on the rotational shaft at a predetermined angle with respect to the first paddle and configured to contact with the top of the sheets and move the sheets to the stopper by rotating with the rotational shaft for aligning the sheets after the first paddle is separated from the sheet, wherein the second paddle is configured to contact with and separate from the sheets while the first paddle makes one rotation around the axis of rotation.

2. The sheet processing apparatus according to claim 1, further comprising a controller configured to control rotation of the shaft rotating the first paddle and the second paddle to suspend the first paddle and the second paddle after the first paddle separates from the sheets and before the second paddle contacts with the sheets.

3. The sheet processing apparatus according to claim 1, further comprising a controller configured to control rotation of the shaft rotating the first paddle and the second paddle, and to stop the first paddle and the second paddle at a position where the first paddle does not disturb sheet conveyance to the standby position and the second paddle is separated from the sheets on the processing section after the second paddle aligns the sheets on the processing section.

4. The sheet processing apparatus according to claim 1, wherein the first paddle has a Young's modulus greater than a Young's modulus of the second paddle.

5. The sheet processing apparatus according to claim 1, wherein a hardness of the first paddle is higher than a hardness of the second paddle.

6. The sheet processing apparatus according to claim 1, wherein a thickness of the first paddle is thicker than a thickness of the second paddle.

7. A sheet processing method, comprising:

receiving a plurality of sheets on a processing section;

rotating a first paddle around an axis of rotation to contact with a top of the sheets on the processing section to draw the sheets into a stopper; and further drawing the sheet into the stopper after the first paddle is separated from the sheet using a second paddle mounted in the axis of rotation at a predetermined angle with respect to the first paddle, wherein drawing the sheet to the stopper by the first paddle and the second paddle is executed while the first paddle makes one rotation around the axis of rotation.

8. The sheet processing apparatus according to claim 1, further comprising controlling the rotation of the first paddle and the second paddle to stop at the positions respectively separated from buffered sheets remaining after drawing the sheet by the first paddle.

9. The sheet processing apparatus according to claim 1, further comprising controlling the rotation to position the first paddle where the first paddle does not disturb buffering and to position the second paddle where the second paddle is separated from the sheet after drawing the sheet by the second paddle.

10. The sheet processing apparatus according to claim 1, wherein a drawing-in quantity of the sheets by the second paddle is smaller than that of the sheets by the first paddle.

11. A sheet processing apparatus, comprising:

a standby section configured to buffer a sheet;

a processing section configured to execute a post processing on sheets supplied from the standby section;

a rotational shaft configured to rotate around an axis of rotation;

a first paddle mounted on the rotational shaft and configured to be rotated around the axis of rotation to contact with the top of the sheets supplied from the standby section to draw the sheets into a stopper; and a second paddle mounted on the rotational shaft at an angle from 90 degrees to 180 degrees with respect to the first paddle and configured to draw the sheet into the stopper after the first paddle is separated from the sheet after a drawing-in operation of the sheets by the first paddle, wherein the drawing-in operation of the sheet to the stopper by the first paddle and the second paddle is executed while the first paddle makes one rotation around the axis of rotation.

12. The sheet processing apparatus according to claim 11, further comprising a controller configured to control rotation of the shaft rotating the first paddle and the second paddle, and to suspend the first paddle and the second paddle at the positions respectively separated from sheets remaining in the processing section after the drawing-in operation of the sheet by the first paddle.

* * * * *